United States Patent [19]

Sippola

[11] Patent Number: 4,971,842

[45] **Date of Patent: * Nov. 20, 1990**

[54] METHOD FOR CONTROLLING THE THICKNESS OF AN INTERMETALLIC LAYER ON A CONTINUOUS STEEL PRODUCT IN A CONTINUOUS HOT-DIP GALVANIZING PROCESS

[75] Inventor: Pertti J. Sippola, Espoo, Finland

[73] Assignee: Rasmet Ky, Helsinki, Finland

[ * ] Notice: The portion of the term of this patent subsequent to Jun. 21, 2005 has been disclaimed.

[21] Appl. No.: 264,963

[22] PCT Filed: Feb. 23, 1988

[86] PCT No.: PCT/FI88/00026

§ 371 Date: Oct. 25, 1988

§ 102(e) Date: Oct. 25, 1988

[87] PCT Pub. No.: WO88/06636

PCT Pub. Date: Sep. 7, 1988

Related U.S. Application Data

[63] Continuation-in-part of Ser. No. 20,106, Feb. 27, 1987, Pat. No. 4,752,508.

[51] Int. Cl.[5] ..... C23C 2/06; C23C 2/36

[52] U.S. Cl. ..... 427/433

[58] Field of Search ..... 427/433, 431

[56] References Cited

U.S. PATENT DOCUMENTS 4,752,508 6/1988 Sippola ..... 427/433

*Primary Examiner*—Sam Silverberg

*Attorney, Agent, or Firm*—Scully, Scott, Murphy & Presser

[57] ABSTRACT

The present invention relates to a method for controlling the thickness of an intermetallic layer on a continuous steel product in a continuous hot-dip galvanizing line. The steel product is rapidly cooled by quenching in a zinc bath and the structure of the coating to be formed on the steel product is controlled by directing a flow of molten zinc, cooled to a temperature 1° to 15° C. below the operating temperature of the zinc bath, towards the steel strip. At least a part of said flow is preferably directed towards the steel product close to its immersion point into the zinc bath, obliquely against the movement direction of the steel product.

5 Claims, 2 Drawing Sheets

THERMAL CYCLE $T_1$ = ANNEALING TEMPERATURE (700-850°C)
$T_2$ = PREQUENCHING TEMPERATURE (600-700 °C)
$T_3$ = END POINT OF RAPID COOLING
(TIME = $T_2 - T_3$ IS 0.5 SECONDS)

METHOD FOR CONTROLLING THE THICKNESS OF AN INTERMETALLIC LAYER ON A CONTINUOUS STEEL PRODUCT IN A CONTINUOUS HOT-DIP GALVANIZING PROCESS

This is a continuation-in-part of U.S. application No. 020,106 filed 2/27/87 now U.S. Pat. No. 4,752,508.

The present invention relates to a method for controlling the thickness of an intermetallic layer on a continuous steel product in a continuous hot-dip galvanizing process. The continuous steel product is generally either a strip or a wire.

A cold-rolled steel strip can be given a good formability by means of a heat treatment disclosed in my earlier U.S. Pat. No. 4,361,448. After annealing at a temperature $T_1$ (720° to 850° C.) the steel strip is slowly cooled to a temperature $T_2$ (600° to 650° C.), from which temperature it is rapidly quenched in a zinc bath to a temperature $T_3$. The time interval between $T_2$ and $T_3$ is about 0.5 seconds.

In the arrangement of the U.S. Pat. No. 4,361,448 a zinc bath cooler and a zinc pump, with nozzles, are separate units. Molten metal having the same temperature as the zinc bath is pumped through a snout to the immersion point of the steel strip. Therefore the end temperature $T_3$ of the rapid cooling is rather high, and the steel strip does not reach the temperature of the zinc bath during the entire immersion time (about two seconds).

A steel strip travelling through a zinc bath causes a laminar zinc flow following the surface of the steel strip. The heat from inside the steel strip raises the temperature of the laminar zinc flow (layer) to a value higher than the operating temperature of the zinc bath. Since iron and zinc react strongly in a conventional zinc bath (containing 0.15 to 0.25% aluminium) at temperature above 480° C., the result is that a thick intermetallic layer is formed on the zinc coating.

In order to achieve a good formability of the zinc coating, the intermetallic layer should be as thin as possible. In the method according to the invention, the thickness of the intermetallic layer is controlled by rapidly cooling the steel product by quenching it in a bath of molten zinc, and controlling the structure of the coating to be formed on the steel product by regulating the end temperature of the steel product in the quenching by directing a flow of molten zinc, cooled to a temperature below the operating temperature of the zinc bath, towards the steel product as it moves through the zinc bath.

Preferably a first flow of molten zinc is directed towards the steel product close to the immersion point thereof and obliquely against the movement direction of the steel product, by means of first nozzles, and a second flow of cooled molten zinc is directed at least essentially perpendicularly towards the steel product at a point after said obliquely directed flow, by means of second nozzles.

The flow of molten zinc directed towards the steel product is cooled e.g. by means of a heat exchanger cooler, preferably to a temperature 1° to 15° C. below the operating temperature of the zinc bath, the flow of zinc through the cooler to said nozzles being separated from the rest of the zinc bath.

The essential feature of locally cooling the zinc bath brings about the additional important advantage that the iron content of the zinc bath is lowered.

The iron content in a zinc bath, in a continuous hot-dip galvanizing process of a thin steel sheet is generally at saturation, according to the respective temperature. Even a small change in the temperature causes a precipitation of iron and zinc, i.e. either at the bottom of the bath or as a drift of precipitates onto the surface of the steel strip to be galvanized, which impairs the quality of the coating.

Thus, to maintain a good quality, variations in the temperature of the zinc bath should be avoided. Therefore, some galvanizing lines are provided with separate pots for preliminary melting of zinc so that e.g. the melting temperature of the zinc to be added would not change the temperature of the zinc bath.

The solubility of iron in molten zinc is generally a linear function of the temperature; at a normal galvanizing temperature of approximately 455° C., the iron content is about 0.06%, and at a temperature of about 420° C., the iron content is about 0.01%. To improve the quality of a hot-dip galvanized thin steel sheet, Fe-Zn precipitates (slag particles) on the zinc coating should be avoided. Thus, it is of advantage to lower the iron content in the zinc bath from the saturated area, whereby a use of different galvanizing temperatures is possible without precipitation of such particles.

By means of the present method, the iron content in the zinc bath is lowered to about 0.025% when the temperature of the zinc bath is about 450° C. and the temperature of the zinc after the cooler about 5° C. lower. Thus, the iron content is at a level about 50% of the saturated value and corresponding to the iron content in a zinc bath at about 430° C.

During the local cooling of the zinc bath, the extra iron precipitates as very small Fe-Al-Zn particles from the molten zinc. When the zinc flows towards the steel strip small Fe-Al-Zn particles adhere as an even layer to the surface of the steel product and leave the zinc bath as a part of the zinc coating.

To keep the Fe-Al-Zn particles as small as possible and homogeneously distributed, the temperature and the rate of the zinc flow should preferably be at constant value. The heat loss caused by the zinc cooler can be compensated by adjusting the speed of the steel product the temperature of which is higher than the temperature of the zinc bath.

Specific features of the invention are stated in the claims and appear likewise from the following description with reference to the enclosed drawing.

FIG. 1 is a thermal diagram illustrating the heat treatment disclosed in the U.S. Pat. No. 4,361,448.

FIGS. 1 and 2 are shown to facilitate the understanding of the prior art such as discussed in the beginning of the specification and to by comparison illustrate the advantages which are achieved by the present invention.

Figure 1:
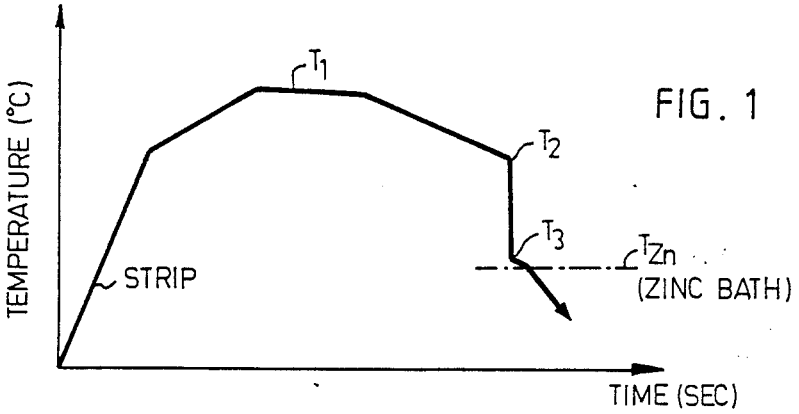
Figure 3:
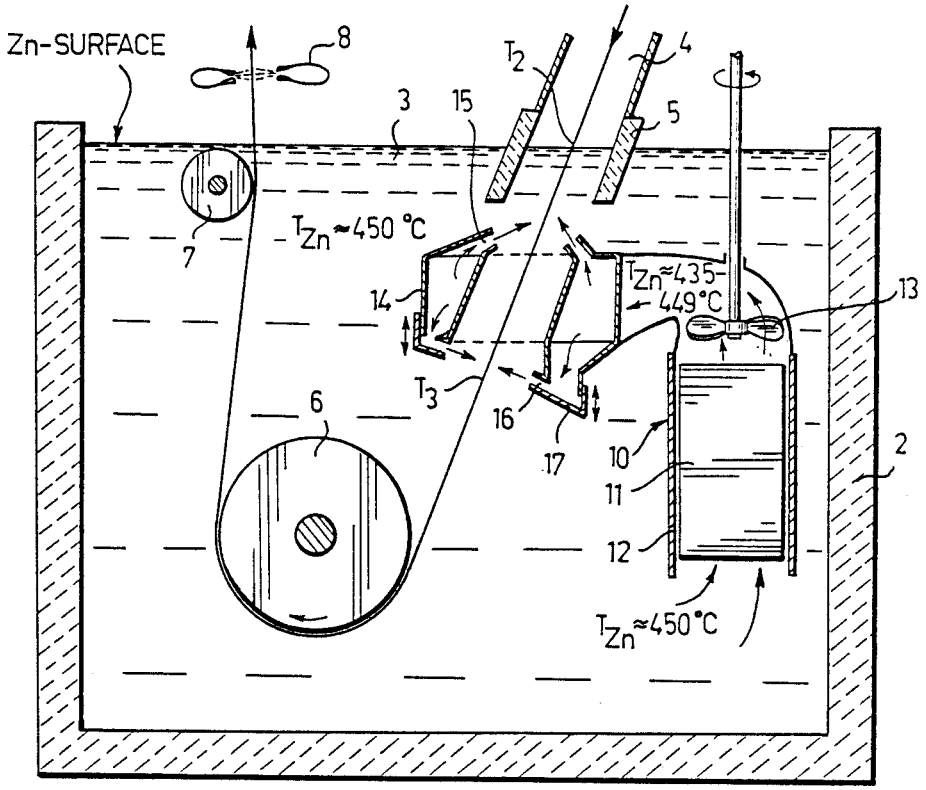
FIG. 3 shows schematically the zinc bath arrangement of the invention, in a longitudinal section.

FIG. 3 shows the new zinc bath arrangement. Reference numeral 1 indicates a continuous step strip, with a thickness of e.g. 1 mm, 2 indicates a pot for a bath 3 of molten zinc with an aluminium content up to about 5%. 4 indicates an end chute of the last zone of a soaking furnace wherein the temperature of the steel is controlled to the temperature $T_2$ (FIG. 1), 5 indicates a snout which may be water cooled, 6 and 7 indicate guide rolls within the zinc bath which rolls can be used for regulating the galvanizing time in a known manner, e.g. by adjusting the roll 6 vertically. Reference numeral 8 indicates gas jet nozzles.

Figure 2:
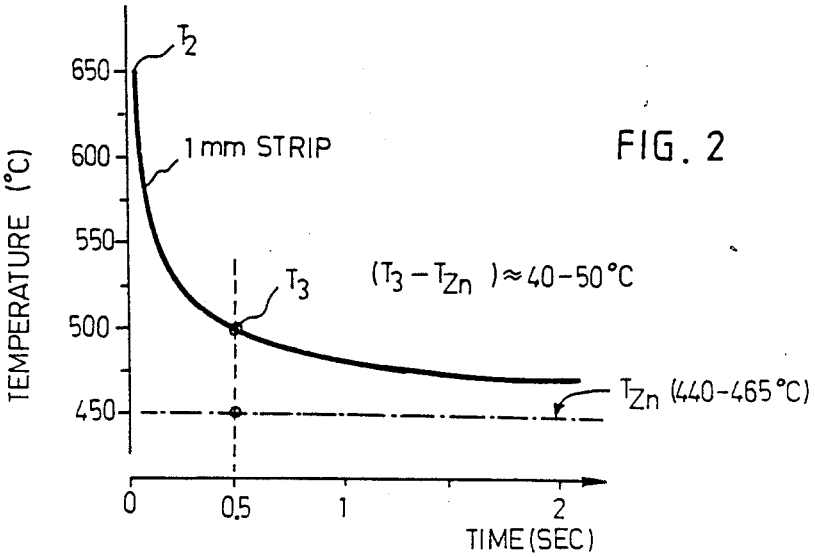
FIG. 2 is a diagram illustrating the cooling (quenching) step in a zinc bath, in the treatment of FIG. 1, for a steel strip having a thickness of 1 mm.

So far the arrangement of FIG. 3 corresponds to FIG. 2 of the U.S. Pat. No. 4,361,448. The treatment steps before the chute 4 and after the gas jet nozzles 18 belong likewise to the prior art, reference can again be made e.g. to FIG. 2 of the U.S. Pat. No. 4,361,448.

The novelty of the zinc bath arrangement shown in FIG. 3, by means of which the present method is carried out, is a specific apparatus for circulating cooled molten zinc towards the steel strip 1 at its immersion into the zinc bath, this apparatus being generally designated by the reference numeral 10. 11 indicates a cooler, 12 indicates a duct surrounding the cooler 11 and 13 indicates a circulation pump after the cooler 11. 14 indicates a nozzle unit with upper nozzles 15 and lower nozzles 16. A bottom part 17 is mounted adjustably to the unit 14 (vertical arrows); a similar arrangement may be provided at the upper nozzles 15.

The zinc bath cooler 11, the zinc pump 13 and the nozzles 15, 16 form an integral unit, so that the temperature of the zinc flowing through the cooler can be lowered 1° to 15° C. below the operating temperature of the zinc bath. The nozzles 15 direct the zinc flow obliquely towards the steel strip, preferably against the travel direction thereof, preventing the warming of the zinc within the snout 5 and the formation of zinc vapors in the furnace 4. The nozzles 16 direct the zinc flow e.g. perpendicularly towards the steel strip. The nozzles are preferably adjustable so that the volume flows of the different nozzles can be varied. The total amount of the zinc flow can be controlled by means of the speed of rotation of the pump 13.

The cooler 11 preferably comprises a number of cooler tubes interspaced in such a manner that the zinc flow nowhere stops in a "dead position" and that the surface temperature of the cooler tubes remains approximately the same across the duct 12. Said surface temperature of the cooler tubes should be kept at a value preventing the zinc from solidifying on the tubes; such a solidification could cause defects in the zinc coating.

Figure 4:
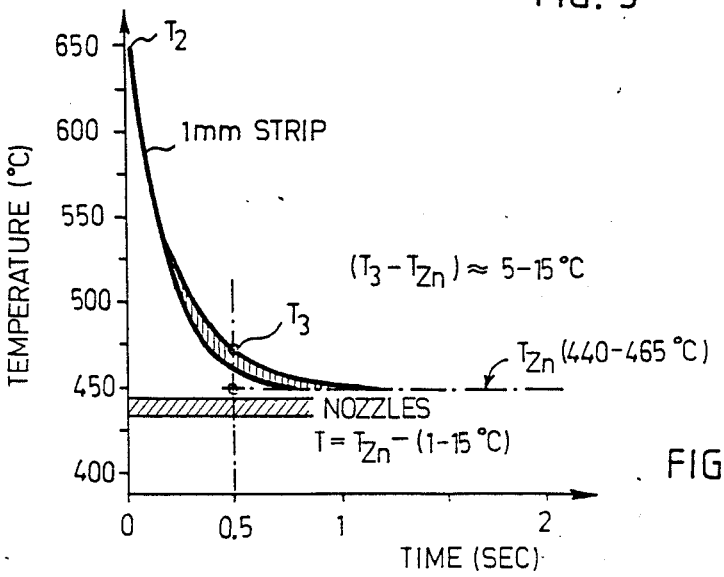
FIG. 4 is a diagram illustrating the cooling (quenching) step according to the invention.

The temperature $T_3$ of the steel strip i.e. the end temperature of the rapid cooling can be reduced and/or controlled by means of the method according to the invention in a manner illustrated in FIG. 4. Provided that $T_3$ is as close as possible to the operating temperature of the zinc bath, e.g. 450° C., the formation of an intermetallic layer, disadvantageous to the forming operation on the zinc coating, is prevented nearly completely in a conventional zinc bath (having an aluminium content of 0.15 to 0.25%). Accordingly, the thickness of an intermetallic layer on the zinc coating of a steel strip can be controlled by varying the temperature of the zinc bath between 440° C. and 465° C. and by adjusting the difference between the temperature $T_3$ and the temperature of the zinc bath. The temperature of the steel strip preferably exceeds 550° C. before entering the zinc bath.

When the aluminium content of the zinc-aluminium bath is about 5%, the operating temperature can be kept between 415° C. and 425° C., so that the method according to the invention makes it possible to reduce the end temperature of the rapid cooling of the steel strip to a value considerably below 450 ® C. This improves the quality of the coating, because the rapid cooling makes the eutectic alloyed coating fine-granular. In addition, the formation of uncoated spots is prevented by the high steel strip temperature in spite of the high surface tension of the zinc alloy.

I claim:

1. A method for controlling the thickness of an intermetallic layer on a continuous steel product in a continuous hot-dip galvanizing process, comprising the steps of rapidly cooling the steel product by quenching it in a bath of molten zinc, and controlling the structure of the coating to be formed on the steel product by regulating the end temperature of the steel product in the quenching by directing a flow of molten zinc, cooled to a temperature below the operating temperature of the zinc bath, said flow of molten zinc is directed towards the steel product close to the immersion point thereof and obliquely against the movement direction of the steel product by means of first nozzles and a second flow of molten zinc is directed at least essentially perpendicularly towards the steel product at a point after said obliquely directed flow by means of second nozzles.

2. A method according to claim 1, wherein the temperature of the cooled zinc flow towards the steel product is 1° to 15° C. below the operating temperature of the zinc bath.

3. A method according to claim 1, wherein the flow of cooled zinc is directed towards the steel product evenly over the width thereof and from both sides.

4. A method according to claim 1, wherein the said first and second nozzles directing the flow of cooled zinc towards the steel products are individually adjustable.

5. A method according to claim 1, wherein the flow of molten zinc directed towards the steel product is cooled by means of a heat exchanger cooler, and flow of zinc through the cooler being separated from the rest of the zinc bath.

* * * * *